United States Patent [19]

Schweppe et al.

[11] 4,002,230

[45] Jan. 11, 1977

[54] PRINT HEAD APPARATUS

[75] Inventors: Joseph L. Schweppe; Jerry L. Miille; Kenneth R. Rhodes, all of Houston, Tex.

[73] Assignee: Houston Engineering Research Corporation

[22] Filed: July 9, 1975

[21] Appl. No.: 594,370

[52] U.S. Cl. ..... 197/1 R; 346/75

[51] Int. Cl.[2] ..... B41J 3/04

[58] Field of Search ..... 101/1; 197/1 R; 346/75, 346/140; 358/75

[56] References Cited

UNITED STATES PATENTS

| | | | |
|---|---|---|---|
| 2,302,185 | 11/1942 | Campbell | 346/75 UX |
| 2,302,289 | 11/1942 | Bramston-Cook | 346/75 UX |
| 2,577,894 | 12/1951 | Jacob | 346/75 |
| 2,614,901 | 10/1952 | Jacob | 346/75 |
| 3,152,858 | 10/1964 | Wadey | 346/75 |
| 3,434,865 | 3/1969 | Doquire et al. | 346/75 UX |
| 3,911,818 | 10/1975 | MacIlvaine | 197/1 R X |

*Primary Examiner*—Ralph T. Rader

*Attorney, Agent, or Firm*—Pravel, Wilson & Gambrell

[57] ABSTRACT

A new and improved print head apparatus for applying ink in a selectively controlled matrix of dots to form letters, numbers, characters and symbols onto packages, containers and the like, which is compact in size and adapted for rapid, accurate movement with controllable ink flow therethrough.

9 Claims, 5 Drawing Figures

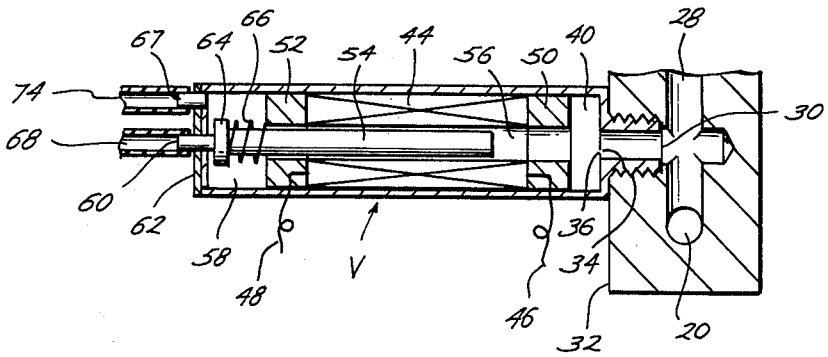
Fig. 4
Fig. 3
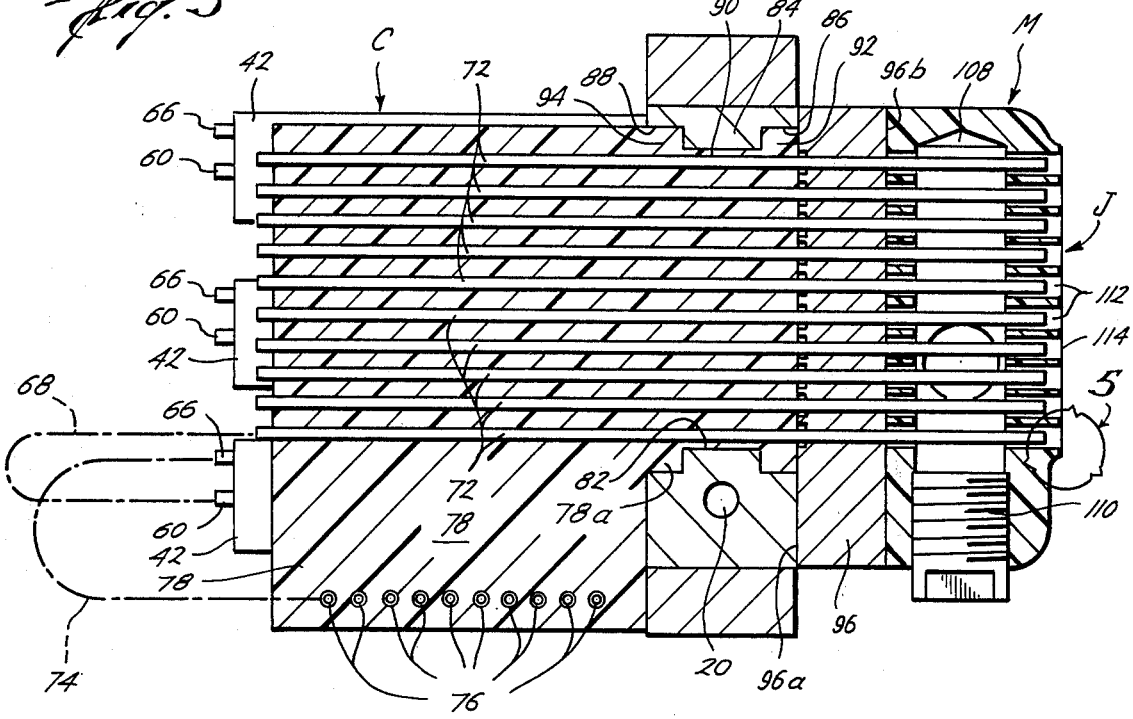
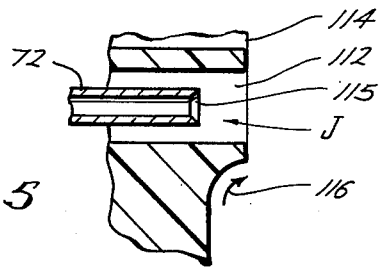
Fig. 5

PRINT HEAD APPARATUS

CROSS-REFERENCE TO RELATED APPLICATIONS

The print head apparatus of the present invention may be used in the automatic label printing apparatus disclosed in U.S. Pat. No. 3.960,072 and in U.S. Pat. No. 3,867,882, both assigned to the assignee of the present invention.

BACKGROUND OF INVENTION

1. Field of Invention:

The present invention relates to print head apparatus.

2. Description of Prior Art:

In printing labels directly and automatically on articles such as packages, containers and the like, operating speed of the printer and accuracy of relative movement between the printer and the article have been important.

Certain apparatus of this general type, such as in U.S. Pat. No. 3,584,571, were comparatively large and unwieldy and comparatively difficult to accurately move and control. Further, these apparatus applied the ink only as groups of line segments, reducing the versatility and flexibility of the apparatus in printing labels such as logos and other symbols and designs. Also, these apparatus recirculated the ink which was not sprayed and were thus unnecessarily complex.

Other prior art apparatus have electrostatically controlled the application of ink drops onto the surface and have thus required complex electronic control circuitry for operational control.

SUMMARY OF THE INVENTION

Briefly, the present invention provides a new and improved print head apparatus for printing a label in the form of a matrix of dots of ink. The apparatus includes a plurality of jets mounted within a manifold which receives a gas, typically air, to spray the ink onto the label. The air manifold is mounted with an ink manifold which distributes ink to a plurality of valves mounted therewith. The valves are connected to the jets by conduits and selectively control the flow of ink to the jets so that characters, letters, numerals, logos, designs and the like may be printed on the label. With the air manifold and valves mounted with the ink manifold, an integral, unitary and compact print head is formed, which is thus small and adapted for rapid relative movement with respect to the label.

It is an object of the present invention to provide a new and improved print head apparatus.

BRIEF DESCRIPTION OF THE DRAWINGS:

FIG. 3 is a cross-sectional view along the line 3—3 of FIG. 2;

FIG. 4 is a cross-sectional view along the line 4—4 of FIG. 2; and

FIG. 5 is a sectional view illustrating in detail the structure circled in FIG. 3 and having the numeral 5 designating same.

DESCRIPTION OF THE PREFERRED EMBODIMENT

Figure 2:
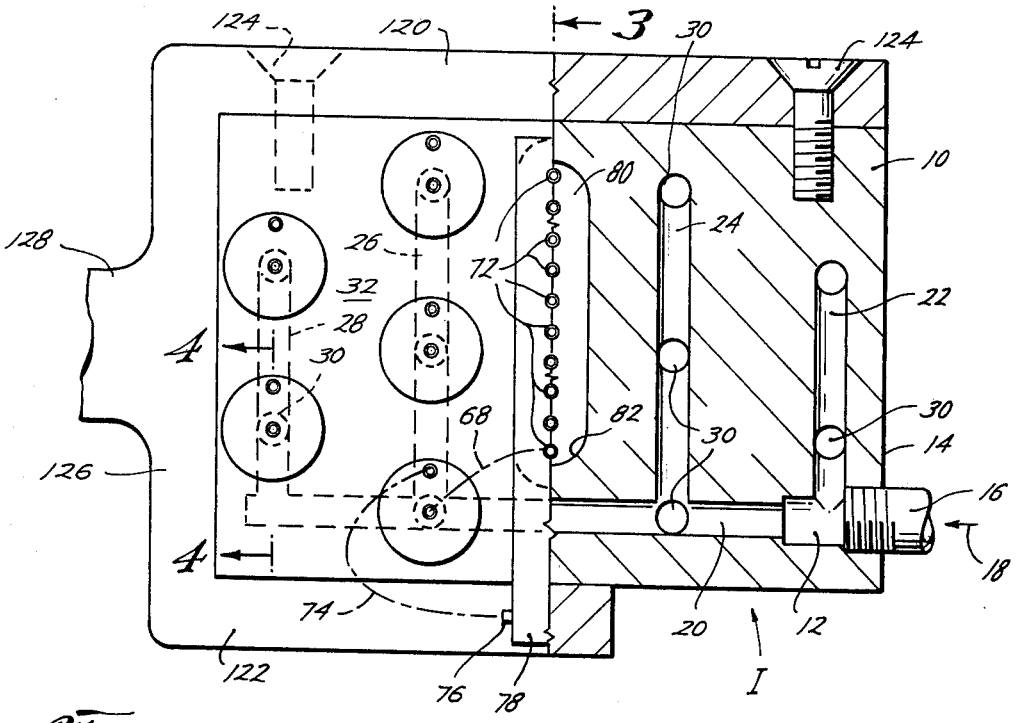
FIG. 2 is a rear elevation view, partly in section, of the apparatus of FIG. 1.

In the drawings, the letter P designates generally the print head apparatus of the present invention. The print head apparatus P is adapted to print a label in the form of a matrix of dots of ink onto articles such as packages, containers and the like. The apparatus P selectively applies the dots of ink, which are typically on the order of 0.1 inches in diameter in a number of matrixes under control of a control computer as the print head apparatus P is moved relative to the label. This relative movement may occur either by moving the print head past a stationary label, or moving a label past a stationary print head. As such relative movement occurs, the dots are selectively applied in number and pattern to form the desired letters, numerals, characters, symbols and the like onto the label being printed.

The label may be printed directly onto packages, containers, rolls of paper and the like, or onto a label mounted on a package, or a label subsequently to be applied to the package.

The apparatus P is thus adapted for use with printers and printer control units such as those disclosed, for example, in U.S. Pat. No. 3,867,882, "Apparatus for Printing Labels Directly Onto Packages, Containers and the Like", and U.S. Pat. No. 3,960,072, "Automatic Label Printing Apparatus" referred to hereinabove, each assigned to the assignee application. The apparatus may also be used with other suitable printer units as well.

In printing operations of the type set forth above, particularly on assembly and production lines, rapid and accurate printing is mandatory, requiring accurate starting and stopping of ink movement, prevention of clogging of ink, and ease of movement of the print head. As will be set forth, the apparatus P permits rapid and accurate printing. The apparatus P includes an ink manifold I which receives ink to be applied to the label and distributes such ink to a plurality of valves V. The valves V selectively control the flow of ink through a plurality of conduits C to a corresponding plurality of jets J which are mounted within an air manifold M which receives and distributes a gas, typically air, about the jets to spray the ink in the form of dots onto the label.

Considering the ink manifold I more in detail (FIG. 2), such manifold is in the form of a plate member 10 of metal or other suitable material having an inlet opening 12 formed in a side wall 14 thereof which receives a conduit 16 therein. The conduit 16 conveys ink, as indicated by an arrow 18, from a suitable ink reservoir or container (not shown) to the ink manifold I.

The ink manifold I includes a transverse ink feed passage 20 and an upwardly extending ink feed passage 22 formed extending inwardly into the ink manifold I from the inlet opening 12. A plurality of upwardly extending ink feed passages 24, 26 and 28 in addition to the passage 22 are formed in the ink manifold I in fluid communication with the transverse ink feed passage 20.

The ink passages 20, 22, 24, 26 and 28 distribute ink throughout the ink manifold I from the inlet opening 12 to plural connecting openings 30 (FIGS. 2 and 4). Considering the connecting openings 30 more in detail, each is of like construction and accordingly the details of one (FIG. 4) will be set forth, it being understood that the remaining openings 30 are of like construction and function, each connecting opening 30 being in the form of a passage formed extending inwardly from a rear surface 32 of the ink manifold I and adapted to receive and mount a valve V therewith.

Considering the valve V more in detail, such valve is an electric solenoid operated flow control valve of suitable construction, such as the valve sold as Model No. 180D3C12 by the Lee Company of Westbrook, Connecticut modified in a manner to be set forth. The valve V has an externally threaded mounting stud 34 formed at a first end thereof which is inserted into a coacting threaded surface 36 adjacent the connecting opening 30. Prior to being so installed, the valve V is modified so that a passage 38 is formed in the mounting stud 34 permitting ink flow from the opening 30 into a chamber 40 within a body portion 42 of the valve V.

A solenoid coil 44 electrically connected by wires 46 and 48 to a control circuit, such as of the type set forth in the U.S. Pat. No. 3,867,882, is mounted by mounting collars 50 and 52 within the housing 42 of the valve V. The solenoid coil 44 and the valve housing 42 are each preferably coated with a suitable epoxy resin to prevent ink fluid damage thereto. The solenoid coil 44 when energized exerts an electromagnetic force on a plunger rod 54 mounted within a central flow channel 56 of the valve V. An ink outlet chamber 58 receives ink through the central flow channel 56 from the inlet chamber 40 of the valve V.

An outlet tube 60 mounted in an end wall 62 of the housing 42 permits ink to flow from the outlet chamber 58 when a sealing plug 64 mounted with the plunger rod 54 is moved in response to actuation of the solenoid coil 44. When the coil 44 is actuated, pressure of ink in the reservoir forces ink from the valve V to displace ink through the conduits C and force a drop of ink from the jet J. Further, it has been found that with the valve V, ink flow therethrough, particularly around the plunger 54 and past the plug 64, provides a self-cleaning action.

A spring 66 is mounted between the collar 52 and the sealing plug 64 in order to urge the sealing plug 64 into sealing engagement with the outlet tube 60 and rapidly prevent flow of ink from the outlet chamber 58 when the solenoid coil 44 is de-energized, thereby providing prompt and accurate control of ink flow. A buffer coupling tube 67 is mounted in the end wall 62 of the housing 42 for reasons to be set forth below.

A flexible coupling conduit 68 (FIGS. 1 and 4) is inserted over the outlet tube 60 to convey ink from the valve V to a rear opening of a jet tube 72 (FIG. 3) of the conduit C. The coupling conduit 68 is shown schematically by a dashed line in FIGS. 2 and 3 in order to more clearly show other structure of the print head apparatus P.

The jet tube 72 is a relatively thin, elongated tube; for example, sixteen-thousandths inch inside diameter and twenty-eight-thousandths inch outside diameter, which conveys ink from the flexible conduit 68 to the jets J formed at an end opening thereof in a manner to be set forth below. Each of the jet tubes 72 is connected with a particular one of the valves V by a coupling conduit of like construction to the coupling conduit 68. However, these coupling conduits are not shown in the drawing in order to more clearly set forth other structure of the print head apparatus P.

When the valve V connected with a particular jet tube 72 is activated by the control circuit, a drop or dot of ink is sprayed on the label at the location specified by the control circuit. The jets J are arranged in a vertical row within the ink manifold I so that if each of the valves V is activated, a substantially continuous vertical bar is formed on the label. Although ten such jets are shown in the preferred embodiment, this is only by way of an example, and it should be understood that other numbers of jets and valves may be used, if desired.

Figure 1:
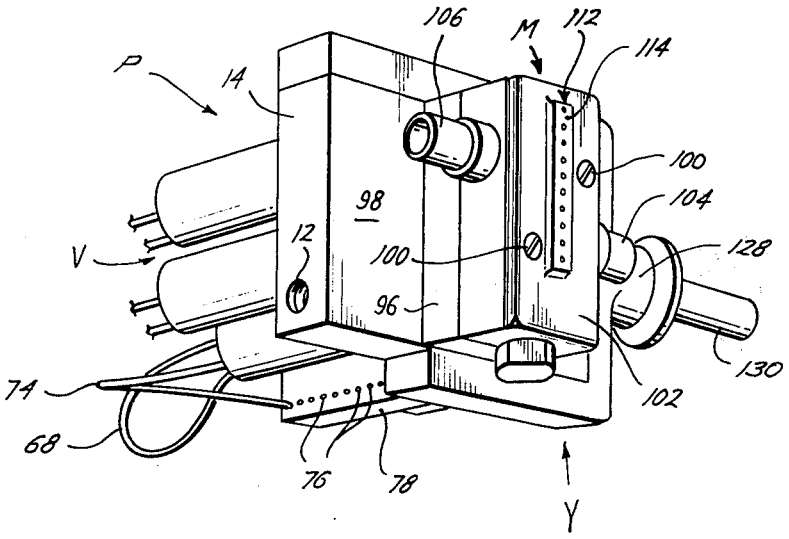
FIG. 1 is an isometric view of the apparatus of the present invention.

With the plural valves V mounted and supplied in common with ink from the ink manifold I, simultaneous activation of several, but less than all, of the valves V has been found to sometimes cause "cross-talk"; i.e., activation of several valves may cause inadvertent activation of other undesired valves due to fluctuations in ink pressure, etc. Accordingly, a buffer conduit 74 (FIGS. 1 and 4) is inserted over the buffer coupling 67 of the valve V at one end thereof and over a solid plug member 76 mounted with a tube housing 78. The buffer conduit 74 is formed from a suitable synthetic resin and is hollow, being plugged at one end thereof by the plug 76. It has been found with the present invention that the buffer conduit 74, due to the compressible air in the hollow interior portion thereof and being plugged by the plug 76, serves as a buffer to absorb fluctuations in ink pressure within the valve V and prevent the inadvertent erroneous activation of undesired ones of the valve V during operation of other selected valves V. As was the case with the conduit 68, the conduit 74 is shown schematically in dashed lines in FIGS. 2 and 3, and only one of such conduits is shown in FIG. 1 in order to more clearly set forth other structure of the print head apparatus P.

The tube housing 78 is a unitary member, formed from a suitable synthetic resin which is preferably cast in a mold in conjunction with a shoulder and opening in the ink manifold I, to be set forth, to form a structure T-shaped in horizontal cross-section, and further with the jet tubes 72 mounted in the mold during casting at proper positions therein. A forward portion 78*a* (FIG. 3) of the tube housing 78 is smaller in size than the rearward portion thereof in order to fit within an elliptical opening 80 formed adjacent an elongated oval inner surface 82 (FIG. 2) of the ink manifold I.

The surface 82 of the ink manifold I is formed on an inwardly extending shoulder portion 84 (FIG. 3) formed between inner mounting recesses adjacent surfaces 86 and 88 in the ink manifold I. The tube housing inner portion 78a has a reduced thickness portion 90 matching the shoulder portion 84 and enlarged inner and outer portions 92 and 94 matching the recesses adjacent surfaces 86 and 88, respectively, in order to mount the tube housing 78 with the ink manifold I.

The air manifold M is a block member mounted with a spacer block 96 on a front surface 98 of the ink manifold I. The spacer block has a plurality of recesses formed on an inner surface 96*a* thereof to provide clearance for any excess synthetic resin resulting from molding the tube housing 78 with the tubes 72 and the ink manifold I in the manner set forth. The spacer block 96 further provides a flush mounting surface 96*b* for mounting the air manifold block member therewith. Screws 100 inserted into a front face 102 of the air manifold M extend through the spacer block 96 to mount the air manifold M and the spacer block 96 with the ink manifold I. The air manifold M receives supplies of a gas, typically air, at slightly higher than atmospheric pressure, e.g. fifteen pounds per square inch, through side inlet openings 104 and 106 on opposite sides of the manifold M from a suitable supply source. The gas enters a distributor chamber 108 (FIG. 3) formed within a central portion of the air manifold M. With the air or gas entering the chamber 108 from opposite sides of the manifold M, distribution of the air flow occurs evenly in the chamber 108. A plug 110 is inserted into an upper portion of the distributor chamber 108 to seal such chamber.

A plurality of applicator outlets 112 are formed in a raised face portion 114 on the front surface 102 of the air manifold M. The jets J are formed at outlets of the tubes 72 by removing a tapered portion from an inner opening 115 at an inner end of the tube 72 (FIG. 5). It is to be noted that the outlets 115 of the jets J may be mounted at a recessed position within the applicator outlets 112 of the air manifold M, if desired, to reduce the possibility of smearing or blurring of the label being printed.

The gas in the distributor chamber 108, being under slightly higher than atmospheric pressure, vents through the applicator outlets 112 past the outlets 115 of the jets J. Accordingly, when the valve V associated with a particular one of the jets J is activated causing ink to flow through the conduit 68 and tube 72, forcing a droplet of ink out of the outlet 115 of the jet J, the exiting air from the distributor chamber 108 passing through the applicator outlet 112 carries along with it the droplet of ink forced from the jet outlet 115, while transforming the ink droplet into a very fine atomized mist which is then transported onto the surface of the label to be printed as a dot of ink, of the typical size set forth above.

It has been found with the present invention that the raised face portion 114 of the air manifold M affords an additional advantage. As the air exits through the applicator outlets 112 of the air manifold M, air is drawn, as indicated by an arrow 116, across the front surface of the air manifold M, preventing accumulation of ink on the front surface of the air manifold M and increasing the legibility and accuracy of the information being printed by the print head apparatus P.

The apparatus P further includes a mounting yoke Y (FIGS. 1 and 2) for connecting the apparatus P with a movement mechanism, such as of the type disclosed in the U.S. Pat. No. 3,867,882 or U.S. Pat. No. 3,960,072 set forth hereinabove.

The mounting yoke Y includes an upper mounting arm 120 (FIG. 2) and a lower mounting arm 122, through each of which screws or other suitable attaching means 124 are inserted to attach and mount the ink manifold I within the mounting yoke Y. The arms 120 and 122 of the yoke Y are interconnected by a base portion 126 from which a connecting arm 128 extends.

Connecting arm 128, including an outer portion 130 thereof (FIG. 1) permits the print head apparatus P to be mounted with a suitable movement mechanism, of the type set forth above, so that the print head apparatus P may be moved relative to the label being printed, by moving the print head with respect to the label, or alternatively moving the label with respect to the print head so that a selected succession of dots of ink are deposited onto the label by the print head apparatus P in the form of a selectively controlled matrix of dots defining the information content of the label being printed.

In the operation of the present invention, as the print head P moves with respect to the label being printed, ink from the ink manifold I is permitted to pass through selected ones of the valves V according to the information being printed by selectively energizing selected ones of the valves V and permitting ink to flow therethrough to the conduit 68 and the jet tube 72, forcing a droplet of ink from the outlet 114 of the jets J which is atomized by air passing from the distributor chamber 108 in the air manifold M through the applicator outlets 112, atomizing the ink droplet and causing such ink to be deposited onto the label. In this manner, as the print head P moves with respect to the label, the selected arrangement of dots in the matrix indicating the information to be printed is formed directly onto the label.

It is important to note that with the valves V and air manifold M mounted with the ink manifold I in the manner set forth, even with the relatively large number of valves and jets, a compact, lightweight printing head is formed according to the present invention, permitting rapid and easily controllable movement of the printing head to occur, increasing the rapidity and accuracy of printing apparatus.

The foregoing disclosure and description of the invention is illustrative and explanatory thereof, and various changes in the size, shape, and materials as well as in the details of the illustrated construction may be made without departing from the spirit of the invention.

We claim:

1. A print head apparatus for printing a label in the form of a selectively controlled matrix of dots of ink, comprising:

a. a plurality of jet tubes for containing ink, each having a jet formed at the end thereof for passage of ink droplets for application as dots of ink on the label;

b. a plurality of coupling conduits, each for conveying ink to one of said plurality of jet tubes;

c. an ink manifold plate having an inlet opening for receiving ink and a plurality of ink passages formed therein for distribution of ink therein to plural connecting openings;

d. said ink manifold plate further having said jet tubes mounted transversely therethrough with said jets of said jet tubes facing the surface of the label, and further with said jets of said jet tubes arranged in a pattern to form a matrix during relative movement with respect to the surface of the label;

e. a plurality of valves, each of said valves having an inlet mounted in one of said connecting openings in said ink manifold plate and an outlet in communication with one of said coupling conduits; and f. each of said valves further including means opening in response to control signals to permit ink to pass therethrough to one of said coupling couduits and one of said jet tubes to said jet thereof to displace a droplet of ink from said jet and apply a dot of ink to the label.

2. The apparatus of claim 1, wherein each of said plurality of jet tubes includes a rear portion and extends outwardly from said ink manifold means and further including:

a tube housing cover member enclosing said rear portions of said jet tubes.

3. The structure of claim 1, further including: an air manifold having said outlets of said plurality of jets mounted therein, said air manifold receiving and distributing a gas about said outlets to spray the displaced dots of ink onto the label.

4. The apparatus of claim 3, wherein:

a. said air manifold means comprises a block member having an inlet opening for receiving the gas and a distributor chamber formed therein for distributing the gas about said plurality of jets; and b. said block member further has a plurality of applicator outlets formed therein adjacent said outlets of plurality of jets for passage of the ink from said jets outwardly onto the label.

5. The apparatus of claim 4, wherein:

said plurality of jets are mounted at recessed positions within said air manifold means adjacent said ink applicator outlets.

6. The apparatus of claim 4, further including:

a raised face portion formed on said block member adjacent said applicator outlets wherein passage of the ink and gas through said outlets draws air across said raised face to prevent accumulation of ink thereon.

7. The apparatus of claim 1, further including:

mounting yoke means for mounting said ink manifold means with a movement mechanism for causing relative movement between the label and said print lead apparatus.

8. The apparatus of claim 1, wherein said plurality of jets are aligned in a row with respect to each other.

9. The apparatus of claim 1, wherein each of said plurality of valve means comprises:

a. means for blocking flow of ink from said ink outlet; and b. control means for selectively opening said means for blocking in response to the control signal.

* * * * *